United States Patent [19]

Menelly et al.

[11] 3,932,783

[45] Jan. 13, 1976

[54] FLUORESCENT LAMP CONTAINING INDIUM OXIDE

[75] Inventors: Richard A. Menelly, Danvers; Tadius T. Sadoski, Salem, both of Mass.

[73] Assignee: Sylvania Electric Products Inc., Danvers, Mass.

[22] Filed: Feb. 14, 1972

[21] Appl. No.: 199,701

Related U.S. Application Data

[63] Continuation of Ser. No. 788,509, Jan. 2, 1969, abandoned.

[52] U.S. Cl. ..... 313/492; 313/192; 313/485

[51] Int. Cl.[2] ..... H01J 63/04; H01J 61/28

[58] Field of Search ..... 313/109, 224

[56] References Cited

UNITED STATES PATENTS

| | | | |
|---|---|---|---|
| 2,491,854 | 12/1949 | Force | 313/197 |
| 3,160,774 | 12/1964 | Guy | 313/92 |
| 3,339,100 | 8/1967 | Menelly | 313/174 X |
| 3,400,288 | 9/1968 | Groth | 313/47 |
| 3,676,729 | 7/1972 | Menelly | 313/109 |

*Primary Examiner*—Robert Segal

*Attorney, Agent, or Firm*—James Theodosopoulos

[57] ABSTRACT

An indium oxide coating is used on the inside surface of a vapor electric discharge lamp, such as a fluorescent lamp, to reduce the starting voltage. The coating is especially effective at low temperatures, but also reduces the voltage even at room temperatures. It is particularly useful also in lamps using certain mixed inert gases with the mercury, since the mixtures used generally require a higher starting voltage than the ordinary fluorescent lamps containing argon and mercury vapor.

3 Claims, 2 Drawing Figures

RICHARD A. MENELLY
TADIUS T. SADOSKI
INVENTORS

BY Lawrence Burns,
ATTORNEY

FLUORESCENT LAMP CONTAINING INDIUM OXIDE

This is a continuation of application Ser. No. 788,509, filed Jan. 2, 1969, now abandoned.

FIELD OF THE INVENTION

This invention relates to electric discharge lamps, for example, fluorescent lamps, particularly to those having a coating of phosphor on the inside surface of an elongated light-transmitting envelope. Such lamps usually have an electrode at each end, and a filling of inert gas and mercury vapor in the envelope.

SUMMARY OF PRIOR ART

The presence of the usual small amount of mercury vapor not only facilitates the emission of light, but also aids the starting of the lamp at ordinary temperatures by lowering the starting voltage. However, at low temperature, such as outdoor temperatures in a Northern winter, and especially at temperatures as low as 20° below zero Fahrenheit, the usual lamp is very difficult to start, and requires a much higher starting voltage, with consequent special ballasts. The normal starting voltage for a 40-watt fluorescent lamp is about 178 volts, at 77°F, but increases to about 257 volts at —22°F.

Moreover, it is sometimes desirable to adjust the operating characteristics of the lamps by mixing two or more inert gases together in considerable percentages, and this increases the starting voltage even at ordinary temperature. This is true despite the fact that the addition of no more than a fractional percentage of a rare gas such as argon to a filling of neon may actually reduce the voltage somewhat, in the absence of mercury, in accordance with the so-called Penning effect. But certain mixtures of rare gases, for example, as in the 40% krypton 60% argon lamps, actually increase the starting voltage, when used with a small amount of mercury.

The use of a coating applied as stannous chloride in the well-known manner for producing transparent conductive coatings, has been tried to improve starting, but these coatings are difficult to apply in production and are erratic in performance.

BRIEF SUMMARY OF INVENTION

We have found that the presence of a coating of indium oxide on the inside surface of the light-transmitting envelope will greatly reduce the starting voltage, especially at low temperatures or with mixed gases, although it will also be reduced even at room temperature or with a single gas. The coating can be applied in a lacquer, dried and heated at several hundred degrees, say 600°C, to burn off the lacquer and leave a coating of indium oxide. The fluorescent coating, if one is to be used, can be then applied over the indium oxide. A reflecting coating of a material such as titanium dioxide, can be used between the two coatings, if desired.

It is interesting to note that indium metal will not achieve the same effect, but will instead alloy with the mercury in the tube, thus reducing the mercury vapor pressure and actually increasing the starting voltage. In fact, the presence of a coating of indium oxide as in our invention will greatly facilitate the starting of discharge lamps containing indium metal to form an alloy with mercury.

The indium oxide coating can be very easily applied in production in the same manner as it the phosphor coating, that is by suspending indium naphthenate in a lacquer and afterward heating the lamp envelope to burn off the lacquer, leaving only the indium oxide on the envelope. But whereas in the case of the phosphor, a coating of particles remains on the glass to form a diffuse or translucent coating, in the case of the indium naphthenate the coating that remains on the glass is actually transparent. As a result, the loss in light transmission is negligible, only about 25 lumens out of the 3200 lumens of a 40-watt cool white fluorescent lamp, that is, less than 1%.

The exact state of oxidation of the indium oxide present in the coating is not known, but it is believed to be one of the lower states of oxidation, because a coating that may have a resistance of only $10^4$—$10^5$ ohms when in the lamp, will have a resistance of $10^9$ohms if the end of the lamp is opened to admit oxygen. In other words, the indium oxide would appear to be InO or $In_2O$ rather than $In_2O_3$.

BRIEF SUMMARY OF DRAWINGS

Other objects, features and advantages of the invention will be apparent from the following specification taken in conjunction with the accompanying drawings, in which:

In FIG. 1 the hermetically-sealed tubular glass envelope 1 has an electrode 2 at each end, and a filling of inert gas. The electrode 2 can be the usual coiled-coil or triply-coiled tungsten filament, carrying the usual coating of electron-emitting alkaline-earth oxides. The electrode 2 is electrically and mechanically connected to the lead-in and support wires 3, 4, which after being hermetically sealed through the end portion or stem 5 of envelope 1, are connected to the contact pins 6, 7 in the base cap 8 of the lamp. The cap is generally attached to the case with a bakelite cement.

Figure 1:
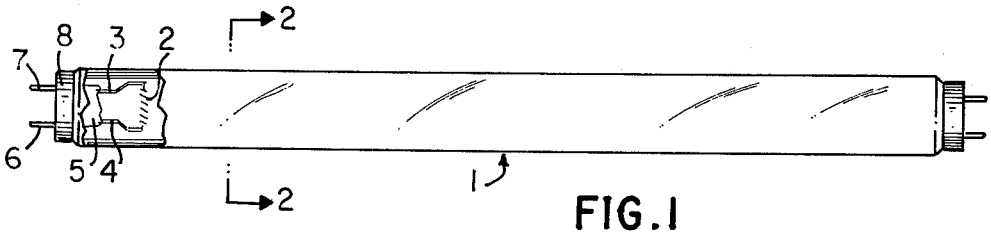
FIG. 1 is an elevational view of the lamp partly borken away to show the interior coatings.
Figure 2:
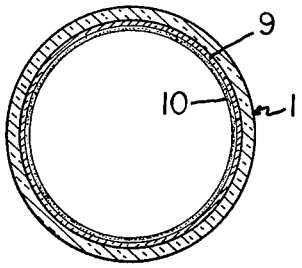
FIG. 2 is an enlarged cross section of the lamp taken on line 2—2 of FIG. 1.

A coating of indium oxide 9, shown in the cross-sectional view of FIG. 2 is on the interior surface of glass envelope 1, and the phosphor coating 10 is over it. The phosphor can be, for example, the usual calcium halophosphate.

If desired, a reflecting coating of titanium dioxide can be present between the indium oxide coating 9 and the phosphor coating 10. Such coatings around a portion of the circumference of a lamp envelope are used in so-called reflector fluorescent lamps and aperture fluorescent lamps. The titanium coating itself would tend to increase the starting voltage rather than to decrease it.

One example which displayed the beneficial starting charactertistics of indium oxide as a precoating for fluorescent lamps using mixed inert fill gases was manufactured in the following manner. Glass bulbs, 47 inches long and 1½ inches in diameter, were washed and dried in the usual manner. A coating was prepared by mixing 10 percent by volume of indium naphthanate to 90 percent by volume of ethyl cellulose laquer which contained roughly 75 percent by volume xylol as a solvent. The naphthanate-ethyl cellulose mixture was then applied directly to the clear glass bulb by pouring the solution in from one end and rotating the bulb until the entire interior bulb surface was covered and the excess solution was poured out. After the coating was completely dry and the ends of the bulb were wiped out up to 2 inches to facilitate bulb sealing, the bulb was baked at a temperature of 600° centigrade for 3 minutes in air in order to remove the ethyl cellulose material and to convert the indium naphthanate to indium oxide. Fluorescent phosphor was then applied over the indium oxide coating by pouring a mixture of fluorescent phosphor, such as calcium halophosphate containing antimony and manganese additives, and ethyl cellulose laquer which has been thinned with xylol as a solvent. The phosphor solution is applied in a similar manner by pouring the solution into one end. After the phosphor coating has completely dried the bulb is again baked at a temperature of 600° for three minutes and the bulb is manufactured into a fluorescent lamp in the usual manner except that a mixture of 40 percent krypton gas and 60 percent argon gas is used as a fill gas instead of the standard fill.

Lamps which were used as control lamps were processed in exactly the same manner except that the indium oxide coating was omitted. Lamp starting voltages were then measured on both the indium oxide coated fluorescent lamps and their controls by applying a continuously increasing voltage across the lamps and recording the voltage at which the lamp lights. Coil heat is applied to both cathodes to make them thermionic emissive during the start cycle. The test result shows 257 starting volts are required to start fluorescent lamps containing argon 60 percent, and krypton 40 percent plus mercury; and only 185 volts are required to start lamps containing the same argon and krypton fill gas mix plus mercury, but having a coating of indium oxide applied beneath the phosphor coating. These results were at −22°F.

At room temperature of 77°F, the lamps with the indium oxide coating started at 160 volts whereas the lamps without the indium oxide coating required 260 volts.

The lamps with the indium oxide coating appear to produce less radio interference than lamps without the coating. It is interesting to note that a lamp coated halfway along its length will light up if the end on the uncoated side is place in contact with a terminal of a radio frequency oscillator of sufficient power, whereas it will remain dark if the end on the side coated with indium oxide is placed in contact with the same part of the oscillator. We have found that a lamp having a conductive coating produced by the application of stannous chloride in the well-known manner will not remain dark, but will light up all along its length, indicating that it is not shielded from radio frequency by the coating.

In the starting tests described, each lamp was operated in the usual rapid start circuit and the voltage gradually raised until starting occurred. The total inert gas pressure in the lamp was 2.00 mm of mercury.

Other indium compounds may be used to produce the desired coating of indium oxide such as: indium resinate, indium octoate, indium stearate, indium nitrate, and indium oxide directly. Other inert gases which may be used with the indium oxide coating are helium, neon, xenon, and mixtures of these gases with each other or with argon and krypton.

Although I have described a particular embodiment of the invention, various modifications will be apparent to a worker skilled in the art without departing from the spirit and scope of the invention, which is set forth in the claims.

The indium oxide if applied directly, or as the nitrate, that is, mixed with a laquer which is afterward burnt off, will produce a translucent, rather than transparent coating, and the coating will not be a continuous film. If will be less effective than the continuous coating or film resulting from use of the naphtanate, resinate, octoate or similar metal organic salts.

What we claim is:

1. A tubular fluorescent lamp comprising a sealed light-transmitting envelope, electrodes therein, a gaseous filling therein, mercury vapor therein, and a substantially transparent coating of indium oxide on the inside surface of said envelope, said indium oxide having the indium in a state of oxidation lower than in $In_2O_3$.

2. A lamp as in claim 1 and a coating of phosphor on said coating of indium oxide.

3. A lamp as in claim 1, in which the envelope is an elongated glass tube, and the electrodes are at opposite ends thereof.

* * * * *